US009097144B2

(12) United States Patent
Kappler

(10) Patent No.: US 9,097,144 B2
(45) Date of Patent: Aug. 4, 2015

(54) VALVE DRIVE ARRANGEMENT FOR ACTUATING GAS EXCHANGE VALVES OF AN INTERNAL COMBUSTION ENGINE

(71) Applicant: Dr. Ing. h.c. F. Porsche Aktiengesellschaft, Stuttgart (DE)

(72) Inventor: Steffen Matthias Kappler, Neidlingen (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 0 days.

(21) Appl. No.: 14/047,376

(22) Filed: Oct. 7, 2013

(65) Prior Publication Data

US 2014/0102393 A1 Apr. 17, 2014

(30) Foreign Application Priority Data

Oct. 11, 2012 (DE) ..... 10 2012 109 689

(51) Int. Cl.

| | |
|---|---|
| ***F01L 1/34*** | (2006.01) |
| ***F01L 1/047*** | (2006.01) |
| ***F01L 1/344*** | (2006.01) |
| ***F01L 13/00*** | (2006.01) |
| *F02M 59/10* | (2006.01) |

(52) U.S. Cl.

CPC ..... *F01L 1/047* (2013.01); *F01L 1/34413* (2013.01); *F01L 13/0036* (2013.01); *F01L 2001/0473* (2013.01); *F01L 2013/0052* (2013.01); *F02M 59/102* (2013.01)

(58) Field of Classification Search

CPC ... F01L 1/34413; F01L 1/047; F01L 13/0036; F01L 2001/0473; F01L 2013/0052; F02M 59/102

USPC ..... 123/90.16, 90.31

See application file for complete search history.

(56) References Cited

U.S. PATENT DOCUMENTS

| | | | | |
|---|---|---|---|---|
| 2,111,828 | A * | 3/1938 | Weaver | 184/6.22 |
| 5,136,780 | A * | 8/1992 | Hishida | 29/888.1 |
| 2010/0162976 | A1 | 7/2010 | Schuler et al. | |
| 2011/0185995 | A1 | 8/2011 | Deblaize et al. | |
| 2011/0280745 | A1 | 11/2011 | Jacques | |
| 2012/0017721 | A1 | 1/2012 | Schmidt | |
| 2012/0079913 | A1 | 4/2012 | Dollinger et al. | |
| 2012/0279467 | A1 | 11/2012 | Scherzinger et al. | |

FOREIGN PATENT DOCUMENTS

| | | | |
|---|---|---|---|
| DE | 34 18 601 | A1 | 11/1984 |
| DE | 10 2008 035 935 | A1 | 2/2010 |
| DE | 10 2008 053 723 | A1 | 5/2010 |
| DE | 10 2009 014 895 | A1 | 10/2010 |

(Continued)

*Primary Examiner* — Zelalem Eshete

(74) *Attorney, Agent, or Firm* — RatnerPrestia

(57) ABSTRACT

A valve drive arrangement for actuating gas exchange valves of an internal combustion engine having a camshaft, on which first and second cam carriers are arranged on first and second contact regions in a non-positive and/or positively locking manner, the first cam carrier having at least one cam for actuating a gas exchange valve and the second cam carrier having at least one cam for actuating an ancillary unit, the first contact region being configured with regard to the geometric dimensions differently in relation to the second contact region in such a way that the second cam carrier can be mounted, without being impeded by the contact regions for the first cam carrier.

7 Claims, 2 Drawing Sheets

(56) References Cited

FOREIGN PATENT DOCUMENTS

| | | | |
|---|---|---|---|
| DE | 10 2011 001 659 | A1 | 10/2010 |
| DE | 10 2009 024 455 | A1 | 1/2011 |
| DE | 10 2010 036 232 | A1 | 11/2011 |
| GB | 2140083 | A | 11/1984 |
| WO | WO 2011/069591 | A1 | 6/2011 |

* cited by examiner

VALVE DRIVE ARRANGEMENT FOR ACTUATING GAS EXCHANGE VALVES OF AN INTERNAL COMBUSTION ENGINE

CROSS-REFERENCE TO RELATED APPLICATIONS

This application claims priority to German Patent Application No. 10 2012 109 689.9, filed Oct. 11, 2012, which is incorporated by reference herein in its entirety.

FIELD OF THE INVENTION

The invention relates to a valve drive arrangement for actuating gas exchange valves of an internal combustion engine having a camshaft, on which first and second cam carriers are arranged on first and second contact regions in a non-positive and/or positively locking manner, the first cam carrier having at least one cam for actuating a gas exchange valve and the second cam carrier having at least one cam for actuating an ancillary unit.

BACKGROUND OF THE INVENTION

A valve drive arrangement of this type is known, for example, from DE 34 18 601 A1, which is incorporated by reference herein. Here, said document discloses a camshaft which can be driven at one end by a belt pulley. Furthermore, the camshaft has cam carriers with cams in a known way, which cams serve to actuate gas exchange valves. At the opposite end from the belt pulley, a cam carrier is applied by way of a press fit, which cam carrier drives an ancillary unit in the form of a fuel pump by means of a cam. It should be clear that a selection restricted in this way of possible attachment positions of the camshaft has an extremely disadvantageous effect on the use of a valve drive arrangement of this type in very different engine variants. Moreover, the dynamic behavior of the camshaft is not optimum on account of the position of the ancillary unit.

It is also to be noted that it is known from the prior art (in this regard, see DE 10 2008 035 935 A1), which is incorporated by reference herein, to provide toothing regions of a camshaft with different profiles, in order to decouple in the axial direction those regions of the toothing system which serve for centering or to separate them from one another.

SUMMARY OF THE INVENTION

Described herein is a valve drive arrangement which ensures actuation of an ancillary unit by the camshaft with as great as possible a freedom of installation space and a simple and inexpensive mounting capability.

The first contact region is configured with regard to the geometric dimensions differently in relation to the second contact region in such a way that the second cam carrier can be mounted, without being impeded by the contact regions for the first cam carrier. It is possible in this way to attach the second cam carrier for actuating the ancillary unit at a position which fits into the installation space; optimization of the dynamic behavior of the camshaft can of course also be achieved.

One particularly advantageous embodiment is provided when the contact regions are configured as toothing regions which have an external toothing system, said toothing regions being in engagement in each case with an internal toothing system of the first cam carriers and the second cam carrier. It is particularly advantageous here if centering of the first toothing region with the first cam carrier is provided in a flank-oriented manner and centering of the second toothing region with the second cam carrier is provided in a tip circle-oriented manner. In this way, during the final mounting, the second cam carrier for operating the ancillary unit can be positioned at any desired position of the camshaft, without mounting of the first cam carriers being impeded. The second cam carrier can advantageously be fixed on the second toothing region in the axial direction by way of a press fit.

In one particularly advantageous embodiment, the first cam carriers have at least two cams and are arranged on the camshaft such that they can be displaced in the axial direction. In this way, a particularly simple and universally applicable sliding cam system is provided in mounting terms. It is advantageous here from a dynamic viewpoint if the second cam carrier is arranged centrally on the camshaft.

In one advantageous embodiment, the ancillary unit is a fuel pump.

BRIEF DESCRIPTION OF THE DRAWING

In the following text, the invention will be explained in greater detail using a drawing, in which.

DETAILED DESCRIPTION OF THE DRAWING

Figure 1:
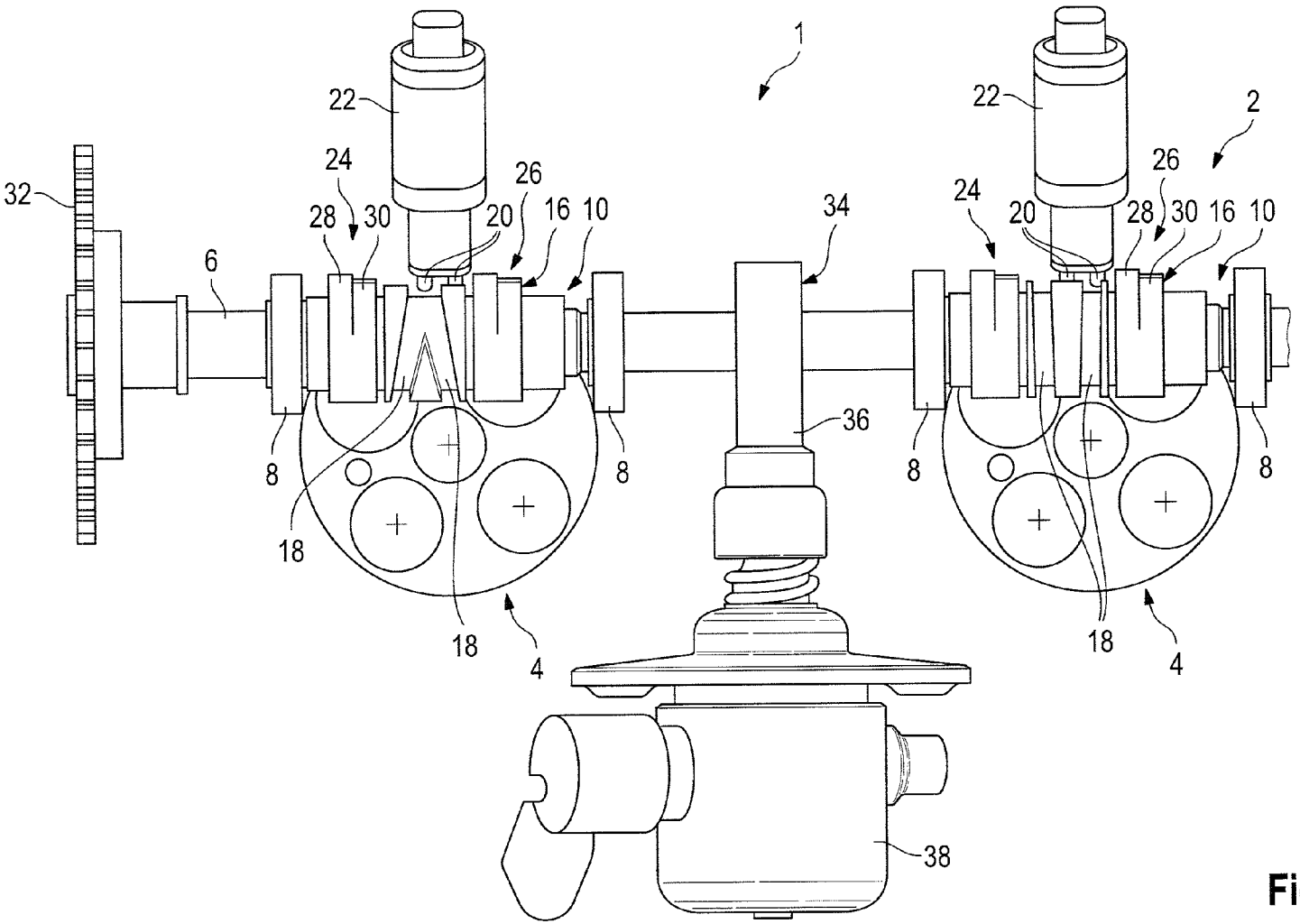
FIG. 1 shows a top view of a valve drive arrangement for actuating gas exchange valves, which valve drive arrangement is configured as a sliding cam arrangement.

FIG. 1 shows a top view of a valve drive arrangement 1 for one bank of a four-cylinder V-engine, of which two cylinders 4 are shown here. In the present exemplary embodiment, the valve drive arrangement 1 has a sliding cam arrangement 2 which is operatively connected to the two cylinders 4 in a known way. Toothing regions 10 are provided on a camshaft 6 in a known way between bearings 8, which toothing regions 10 have an external toothing system 12 (in this regard, see FIGS. 2 and 3) and which are in engagement in each case with an internal toothing system 14 of a cam carrier 16. In the present exemplary embodiment, a cam carrier 16 is provided for two gas inlet valves (not shown in further detail) and has grooves 18 here which interact with drivers 20 of an actuator 22 in such a way that the respective cam carriers 16 can be displaced on the camshaft 6 in the axial direction. Furthermore, each cam carrier 16 has a cam pair 24, 26 with cams 28, 30 which can be brought into engagement in each case with the associated gas exchange valve and accordingly cause a different lifting characteristic of the gas exchange valve. For the sake of completeness, it is also noted that the component which is denoted by the designation 32 is a chain sprocket for driving the camshaft 6.

Furthermore, a second cam carrier 34 is provided which actuates a fuel pump 38 by means of a cam 36.

Figure 2:
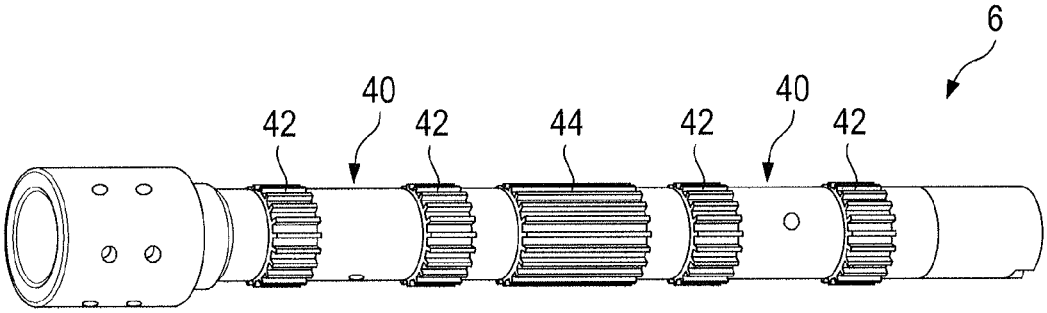
FIG. 2 shows a perspective view of a camshaft which can be used in a valve drive arrangement according to FIG. 1.

FIG. 2 then shows a perspective view of the camshaft 6 from FIG. 1. The first contact regions for the first cam carriers 16 are then denoted in each case by 40. Said first contact regions 40 are configured here as toothing regions which in each case have two external toothing systems 42. It should be clear that the toothing regions 40 can also have merely one continuous toothing region 42, but the form which is shown has been selected in the present exemplary embodiment for cost reasons. Furthermore, a second contact region 44 is shown which likewise has an external toothing system and onto which the second cam carrier 34 can be mounted by means of a press fit. Furthermore, it is provided that centering of the first toothing region 40 with the first cam carrier 16 takes place in a flank-oriented manner. The centering of the second cam carrier 34 with the second toothing region 44 takes place in a tip circle-oriented manner. This ensures that firstly the selection of the position for the second toothing region 44 can be selected freely on the camshaft 6. Furthermore, it is ensured that the second cam carrier 34 can be mounted on the second toothing region 44 in a very simple way, without being impeded by the first toothing regions 40.

Figure 3:
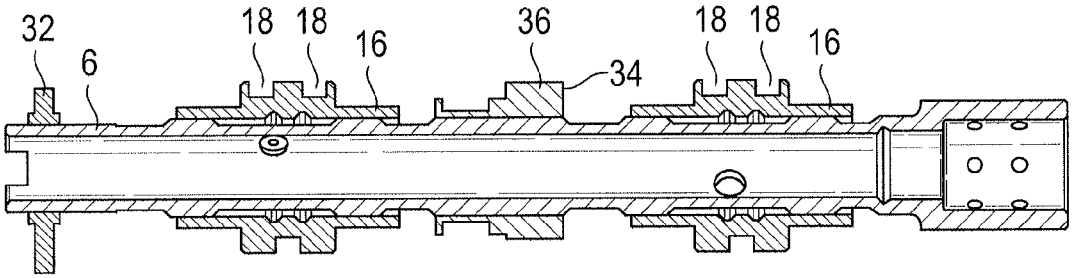
FIG. 3 shows a sectional view of the camshaft with mounted first and second cam carriers.

FIG. 3 then shows a sectional view through the camshaft 6 with mounted cam carriers 16, 34. Merely the cam 36 of the cam carrier 34 can be seen in this view. It can be clearly seen, furthermore, how the internal toothing systems of the first cam carriers 16 and the second cam carrier 34 enter into engagement with the respective external toothing systems of the toothing regions 40, 44. 18 denotes the grooves known from FIG. 1 for the engagement of the drivers 20 of the actuator 22.

It should be clear that the exemplary embodiment which is shown here represents merely one embodiment of the invention.

What is claimed:

1. A valve drive arrangement for actuating gas exchange valves of an internal combustion engine comprising:

a camshaft, on which first and second cam carriers are arranged on first and second toothed contact regions, respectively, the first cam carrier being slidably mounted on the first toothed contact region of the camshaft and the second cam carrier being press fit and fixedly mounted on the second toothed contact region of the camshaft, the first cam carrier having at least one cam for actuating a gas exchange valve and the second cam carrier having at least one cam for actuating an ancillary unit, wherein the first contact toothed region has different geometric dimensions than the second toothed contact region such that, upon assembling the valve drive arrangement, a toothed region of the second cam carrier is configured to pass over the first toothed contact region of the camshaft without being impeded by the first contact toothed region for the first cam carrier and then be press fit and fixedly mounted to the second toothed contact region of the camshaft.

2. The valve drive arrangement as claimed in claim 1, wherein the first and second toothed contact regions have an external toothing system, said first and second toothed contact regions being in engagement with an internal toothing system of the first and second cam carriers, respectively.

3. The valve drive arrangement as claimed in claim 1, wherein centering of the first toothed contact region with the first cam carrier is provided in a flank-oriented manner and centering of the second toothed contact region with the second cam carrier is provided in a tip circle-oriented manner.

4. The valve drive arrangement as claimed in claim 1, wherein the second cam carrier is fixed onto the second toothed contact region in an axial direction by way of the press fit.

5. The valve drive arrangement as claimed in claim 1, wherein the first cam carrier has at least two cams and is arranged on the camshaft such that it is configured to be displaced in an axial direction.

6. The valve drive arrangement as claimed in claim 1, wherein the second cam carrier is arranged centrally on the camshaft.

7. The valve drive arrangement as claimed in claim 1, wherein the ancillary unit is a fuel pump.

* * * * *